US005445220A

United States Patent [19]

Gurevich et al.

[11] Patent Number: 5,445,220

[45] Date of Patent: Aug. 29, 1995

[54] APPARATUS FOR INCREASING PRODUCTIVITY BY CUTTING OPENINGS THROUGH CASING, CEMENT AND THE FORMATION ROCK

[75] Inventors: Alexander E. Gurevich, Los Angeles, Calif.; Ralph R. Horlacher, Scottsdale, Ariz.

[73] Assignee: Allied Oil & Tool Co., Inc., Scottsdale, Ariz.

[21] Appl. No.: 189,548

[22] Filed: Feb. 1, 1994

[51] Int. Cl.[6] ..... E21B 29/06

[52] U.S. Cl. ..... 166/55; 166/223

[58] Field of Search ..... 166/55, 55.1–55.3, 166/55.8, 222, 223, 298

[56] References Cited

U.S. PATENT DOCUMENTS

| | | | |
|---|---|---|---|
| 2,315,496 | 4/1963 | Boynton | 166/1 |
| 3,130,786 | 4/1964 | Brown et al. | 166/55 |
| 3,850,241 | 11/1974 | Hutchinson | 166/222 |
| 3,892,274 | 7/1975 | Dill | 166/222 |
| 4,047,569 | 9/1977 | Tagirov et al. | 166/308 |
| 4,050,529 | 9/1977 | Tagirov et al. | 166/298 X |
| 4,134,453 | 1/1979 | Love et al. | 166/77 |
| 4,285,398 | 8/1981 | Zandmer et al. | 166/223 X |
| 4,346,761 | 8/1982 | Skinner et al. | 166/55.1 X |
| 4,479,541 | 10/1984 | Wang | 166/268 |
| 4,527,639 | 7/1985 | Dickinson et al. | 166/50 X |
| 4,640,362 | 2/1987 | Schellstede | 166/223 X |
| 4,765,173 | 8/1988 | Schellstede | 166/55.2 X |

FOREIGN PATENT DOCUMENTS

| | | |
|---|---|---|
| 1782275 | 12/1990 | Russian Federation . |
| 415355 | 2/1974 | U.S.S.R. . |
| 618537 | 8/1978 | U.S.S.R. . |
| 619632 | 8/1978 | U.S.S.R. . |
| 977729 | 11/1982 | U.S.S.R. . |

*Primary Examiner*—Roger J. Schoeppel
*Attorney, Agent, or Firm*—Workman, Nydegger & Seeley

[57] ABSTRACT

A perforator to increase conductivity of a deposit bearing region of oil, gas, and/or water saturating a rock formation having a wellbore hole therethrough and, thus, increase production by cutting elongated openings (slots) through casing, cement bond and formation rock. The perforator is attached to the bottom end of a string of drill pipes. The string of drill pipes are connected to a surface raising and lowering device for raising and lowering the string of drill pipes into a wellbore hole. A pump pumps an abrasive liquid into the perforator through the string of drill pipes. The perforator has telescoping nozzles and double jet nozzles. The abrasive liquid is jetted at a high velocity out of the telescoping jet nozzles and the double jet nozzles. By shifting the perforator with the raising and lowering device while pumping the abrasive liquid into the perforator, slots are cut in the casing, cement bond and formation rock along wellbore axis. A stream of abrasive liquid ejected from the telescopic jet nozzle penetrates and deepens the slot made by a stream of abrasive liquid ejected from double jet nozzles. The abrasive liquid returns to the surface of the well in the annulus between the casing and the string of drill pipes to the wellhead and exits the annulus through the side outlet.

17 Claims, 4 Drawing Sheets

APPARATUS FOR INCREASING PRODUCTIVITY BY CUTTING OPENINGS THROUGH CASING, CEMENT AND THE FORMATION ROCK

BACKGROUND

1. Field of the Invention

The invention relates to a method for increasing production from a well through the use of an apparatus that perforates and slots through casing, cement bond and into a rock formation so as to increase conductivity between oil, gas, and/or water in the rock formation.

2. Background Art

Making deep slots in rock formations increases conductivity by opening permeable beds and fractures that are intersected by the well or are located near the well within the distance of the slot depth. Deep slots improve the conductivity of the well where the depth of the slots extend beyond a rock formation zone that has been damaged by stress, or extend beyond a region of pore clogging around a well that has caused a reduction is the permeability of the rock.

A method and apparatus for cutting round perforations and elongated slots in well flow conductors was offered in U.S. Pat. No. 4,134,453, which disclosure is incorporated herein by reference. The disclosed apparatus has jet nozzles in a jet nozzle head for discharging a fluid to cut the perforations and slots. The length of the cuts that the disclosed jet nozzle makes into the rock formation is limited because the jet nozzle is stationary with respect to the jet nozzle head.

A method and apparatus for cutting panel shaped openings is disclosed in U.S. Pat. No. 4,479,541, which disclosure is incorporated herein by reference. The disclosed apparatus, a perforator, has two expandable arms, each arm having an end with a jet thereat, the jet emitting a jet stream therefrom. The cutting function is disclosed as being accomplished by longitudinally oscillating, or reciprocating, the perforator. By a sequence of excursions up and down within a particular well segment, a deep slot is supposed to be formed. The offered method cannot, however, be performed because only an upward motion along a well is possible due to the design of the expandable arms. Further, a motion in a downward direction will be stopped by the two expandable arms which set against the well wall. As a result of the very sharp angle formed between the well wall and jet streams emitted at the jets at the ends of the expandable arms, only small scratches will be cut in the well walls.

BRIEF SUMMARY AND OBJECTS OF THE INVENTION

It is an object of the invention to increase conductivity of a well by providing a perforator having a moveable jet nozzle relative to the body of the perforator, where the movement of the jet nozzle enables an increased depth of cut in a rock formation.

It is a further object of the present invention to provide a perforator having a jet nozzle that is capable of moving within a well wall both in an upward motion along the well and in a downward direction, the jet nozzle making a deep slot in the rock formation with a jet stream from the jet nozzle.

It a still further object of the present invention is to optimize the motion rate of a perforator cutting slots into a rock formation while maximizing the penetration depth accomplished by the perforator into the rock formation.

Another object of the present invention is to provide a perforator having a plurality of nozzles, where a first nozzle emits a jet stream therefrom that makes a partial penetration into a rock formation, and a next nozzle that emits a jet stream therefrom that penetrates further into the rock formation past the penetration of the first nozzle.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the forgoing objects, and in accordance with the invention as embodied and broadly described herein there is provided a perforator attached on the bottom end of a string of drill pipes to be lowered into a well. The drill pipes are connected to a pump. An abrasive liquid is pumped into the perforator through the string of drill pipes by the pump, where the abrasive liquid comprises a liquid having an abrasive material therein.

The exterior of the perforator has a jet nozzles means thereon for ejecting therefrom the abrasive liquid that is pumped into the string of drill pipes. By lowering or raising the string of drill pipes, the perforator is shifted in position within the well. While pumping the liquid therethrough into the perforator, the jet nozzles means ejects the abrasive liquid at a high velocity onto the casing of the well walls. The abrasive material in the abrasive liquid aids in cutting slots by abrasively penetrating the casing, the cement bond under the casing, and the rock formation beyond the cement bond.

The jet nozzles means of the perforator comprises a telescopic nozzle means for cutting slots and a double jet nozzle means for cutting slots. The double jet nozzle means is in a stationary position with respect to the perforator and makes a slot in the rock formation of a first depth, the slot having a width sufficient to permit the telescopic nozzle means to extend into the slot cut by the double jet nozzle means. The telescoping nozzle means moves between a retracted position and an extended position relative to the perforator into the slot cut by the double jet nozzle means. The extended position of the telescopic nozzle means enables the telescopic nozzle means to extend into the slot that was cut by the double jet nozzle means and further deepen the slot cut by the double jet nozzle means deeper into the rock formation to a second depth, where the second depth is deeper than the first depth. Thus, the invented method and apparatus enables an increased and optimal perforator motion rate while cutting a slot deep into the rock formation, as compared to a perforator motion rate for a perforator having only a single jet nozzle, by cutting a slot in two steps. The first step is to cut a slot with the double jet nozzle means so as to make a partial penetration of the rock formation, and the second step is to further deepen the cut slot with the telescopic nozzle means in the extended position thereof so as to complete the slot being cut to a maximal depth.

For stability from rotation about the longitudinal axis of the wellbore during the slot cutting operation, the perforator further comprises a telescopic guide fin means. For keeping the perforator centered about the longitudinal axis of the wellbore during the slot cutting operation, the perforator further comprises a stabilizer means. The telescopic guide fin means moves between a retracted position and an extended position relative to the perforator under pressure of liquid in the perforator. Biasing means are used to bias the telescopic guide fin means and the telescopic nozzle means into the respective retracted position thereof. The pressure of the abrasive liquid in the perforator biases the telescopic nozzle means and the telescopic fin means into the respective extended positions thereof.

The perforator further comprises a check valve means for holding and releasing pressure in the perforator when the abrasive liquid is respectively pumped therein or the pressure in the perforator is decreased by pumping the abrasive liquid out of the perforator.

As the abrasive liquid is ejected from the double jet nozzle means, the ejected abrasive liquid cuts a slot in the casing, cement bond, and the rock formation. The telescopic nozzle means extends from the perforator due the pressure of the abrasive liquid in the perforator. In the extended position, the telescopic nozzle means ejects therefrom the abrasive liquid so as to penetrate and deepen the slot made by the ejected abrasive liquid from double nozzle means.

The abrasive liquid ejected from the perforator flows upwardly to a wellhead at the surface of the well by flowing in an annulus formed between the string of drill pipes and the casing of the well. A side outlet at the surface of the well near the wellhead serves as an ejection port from which the abrasive liquid exits the well.

By moving the perforator suspended from the string of drill pipes within the wellbore, a slot is cut into the rock formation. After cutting the slot in the rock formation, the motion of the string of drill pipes and the pump are stopped. The pump is then reversed to reverse the flow direction of the abrasive liquid in the string of drill pipes. The reversed pressure created by the pump, and the respective biasing means thereof, causes the telescopic nozzle means and the telescopic guide fin means to move into the respective retracted positions thereof. The negative pressure of the abrasive liquid in the perforator causes the check valve means in the perforator to open. Once the check valve means is open, the abrasive liquid in the perforator will exit the perforator at the check valve means. The well may then be washed by pumping into the well a liquid that does not have an abrasive material therein.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are therefore not to be considered limiting of its scope, the invention in its presently understood best mode for making and using the same will be described with additional specificity and detail through the use of the accompanying drawings in which.

DETAILED DESCRIPTION OF THE PREFERRED EMBODIMENTS

Figure 1:
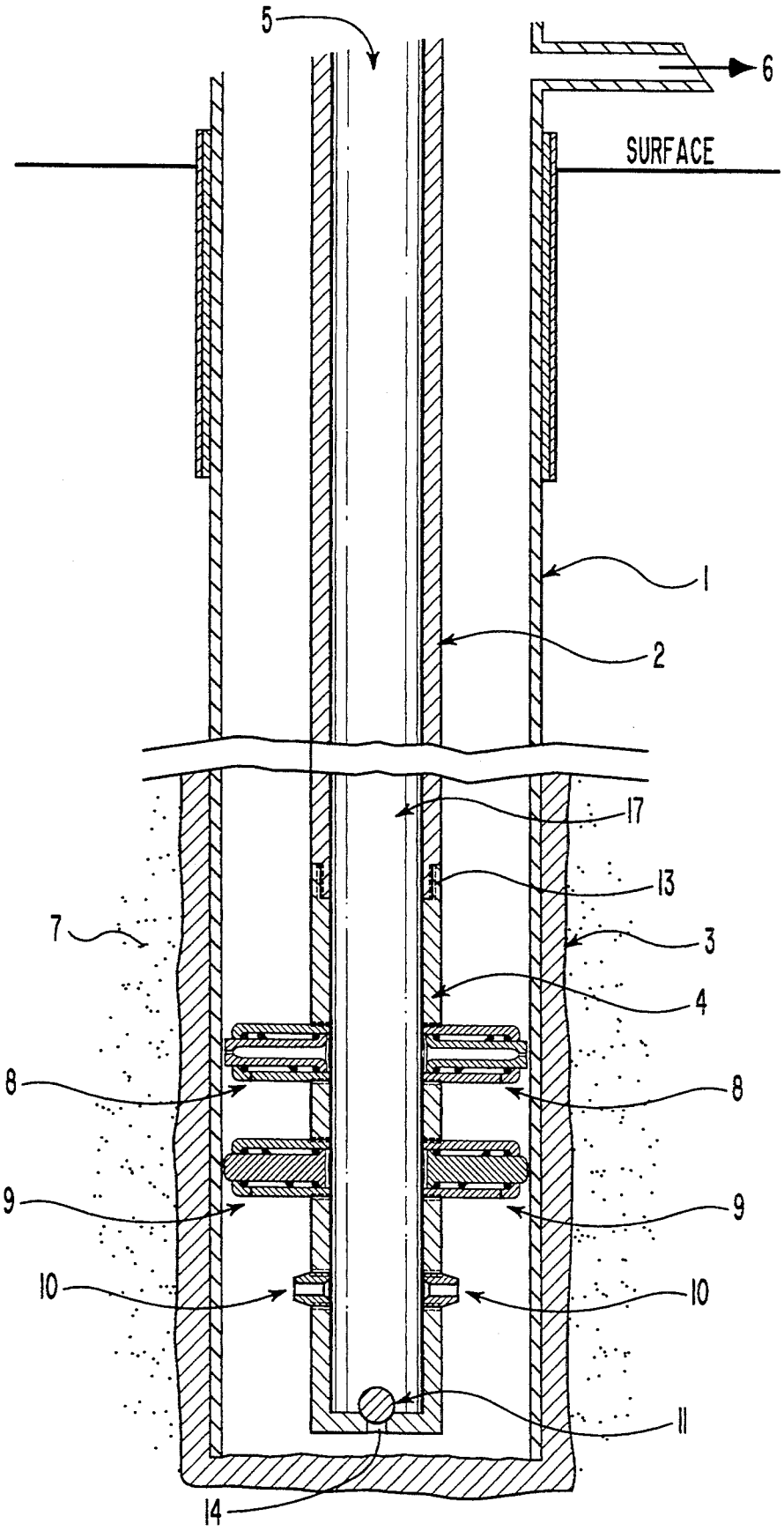
FIG. 1 is a two dimensional cutaway elevational view showing a preferred embodiment of the inventive perforator suspended from a string of drill pipes within a well.

FIG. 1 depicts a wellbore being lined with a well having a casing 1, casing 1 being cemented in the wellbore by the illustrated cement bond 3, cement bond 3 being surrounded by a rock formation 7. The wellbore has a longitudinal axis 17. A preferred embodiment of the inventive perforator is shown in FIG. 1 as a perforator 4. Perforator 4 is shown as being attached at a lower end of a string of drill pipes 2 at a thread joint 13. Drill pipes string 2 and perforator 4 are lowered into casing 1 of the well, or are pulled up to the surface of the well by a lifting device (not shown). The lifting device lowers into the well bore drill pipes string 2 having perforator 4 at the bottom end thereof, which perforator 4 is lowered into the wellbore until perforator 4 reaches a depth of the wellbore where the cutting of slots is to be done.

An abrasive liquid (not shown) enters the string of drill pipes 2 at in a path 5 by being pumped from the surface by pumps (not shown) through drill pipes string 2 down to perforator 4. Preferably, the inventive perforator has a telescopic nozzle means with a biasing means therefor, and a double jet nozzle means, each of which serves to cut slots in casing 1, cement bond 3, and rock formation 7. By way of example and illustration of the telescopic nozzle means and the double jet nozzle means, FIG. 1 respectively shows a telescopic nozzle 8 and a double jet nozzle 10 on each side of perforator 4. Telescopic nozzle 8 and double jet nozzle 10 are fixed in perforator 4 and are directed orthogonally at casing 1 on opposite sides of perforator 4.

The inventive perforator preferably has a check valve means for maintaining the pressure of the abrasive liquid in the perforator. By way of example and illustration of the check valve means, FIG. 1 shows a ball 11 in a ball check valve seat 14 at the bottom of perforator 4. Ball 11, when seated in ball check valve seat 14, causes the pressure in perforator 4 to increase when the abrasive liquid is pumped into perforator 4. Conversely, when the pressure in perforator 4 is decreased by pumping the abrasive liquid out of perforator 4, ball 11 will be displaced from ball check valve seat 14 so as allow the abrasive liquid in perforator 4 to flow out of perforator 4.

Figure 2:
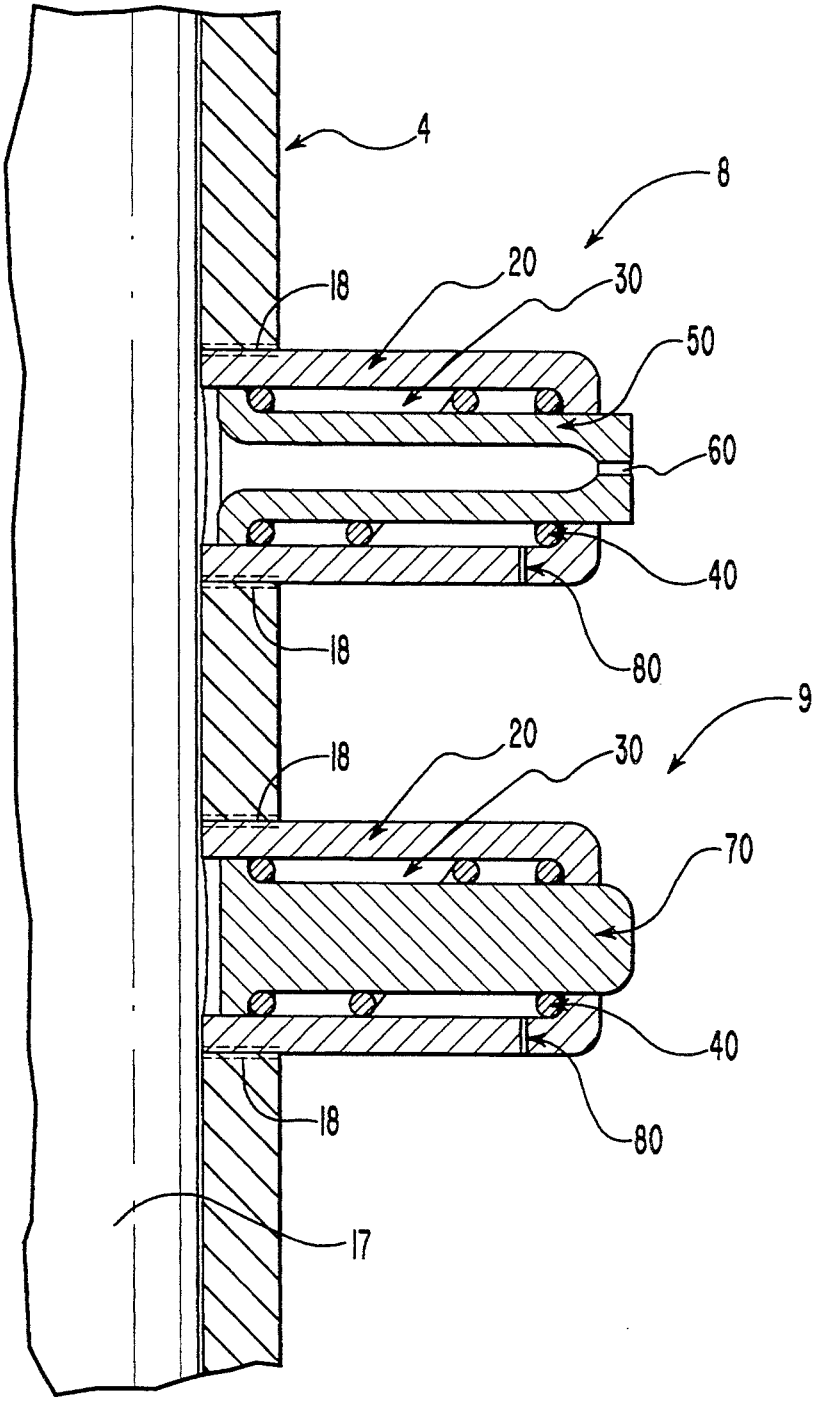
FIG. 2 is a cutaway view of one side of the perforator of FIG. 1, depicting a telescopic nozzle and a telescopic guide fin, each being in a retracted position thereof.

It is preferable that the inventive perforator have a telescopic guide fin means for preventing the inventive perforator from rotating in the wellbore about the axis thereof during the slot cutting, which telescopic guide fin means is accompanied by a biasing means. An example and illustration of the telescopic guide fin means is shown in FIG. 2 as a telescopic guide fin 9. Telescopic guide fin 9 moves relative to perforator 4 between a retracted position, shown in FIG. 2, and an extended position to be explained.

Telescopic nozzle 8 and telescopic guide fin 9 are shown on one side of perforator 4 in FIG. 2, each of which being connected to perforator 4 respectively at a thread joint 18 and a thread joint 19. Both telescopic nozzle 8 and telescopic guide fin 9 have an outer cylinder 20, and a spring 40 in outer cylinder 20. Springs 40 serves as an example of the previously mentioned biasing means. Telescopic nozzle 8 has an inner cylinder 50. There is an annular space 30 inbetween inner cylinder 50 and outer cylinder 20. Inner cylinder 50 of telescopic nozzle 8 has a jet 60 at an end thereof for ejecting therefrom the abrasive liquid. Telescopic guide fin 9 has a solid guide fin piston 70 in outer cylinder 20 of telescopic guide fin 9. There is an annular space 30 inbetween guide fin piston 70 and outer cylinder 20 of telescopic guide fin 9.

To install telescopic nozzle 8 in perforator 4, outer cylinder 20 of telescopic nozzle 8 has spring 40 and inner cylinder 50 inserted therein after which outer cylinder 20 of telescopic nozzle 8 is filled with a liquid (not shown), such as water. After filling outer cylinder 20 of telescopic nozzle 8 with the liquid, telescopic nozzle 8 is installed into perforator 4 at thread joint 18.

To install telescopic guide fin 9 in perforator 4, outer cylinder 20 of telescopic guide fin 9 has spring 40 and guide fin piston 70 inserted therein after which outer cylinder 20 of telescopic guide fin 9 is filled with a liquid (not shown), such as water. After filling outer cylinder 20 of telescopic guide fin 9 with the liquid, telescopic nozzle 8 is installed into perforator 4 at thread joint 19.

Telescopic nozzle 8 and telescopic guide fin 9 have a small hole 80 in the respective outer cylinder 20 thereof.

Figure 3:
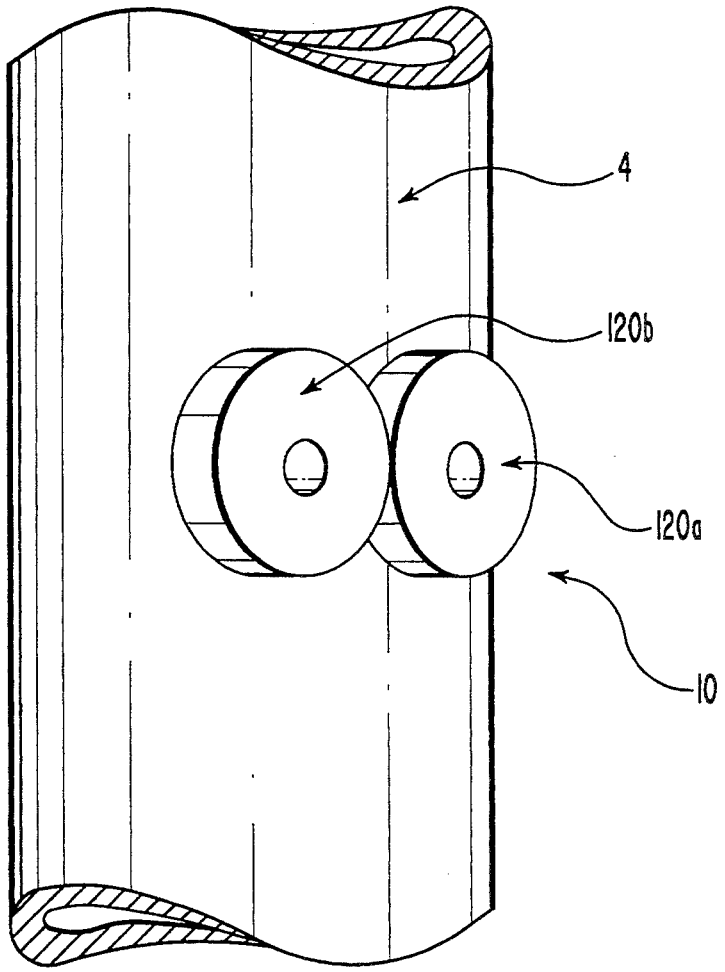
FIG. 3 is a three dimensional cutaway view of FIG. 1, depicting a double jet nozzle having two parallel jets.

Double jet nozzle 10 is seen in FIG. 3 having two parallel jets 120*a*, 120*b* for ejection therefrom of abrasive liquid (not shown), where double jet nozzle 10 is shown as being installed in perforator 4.

Figure 4:
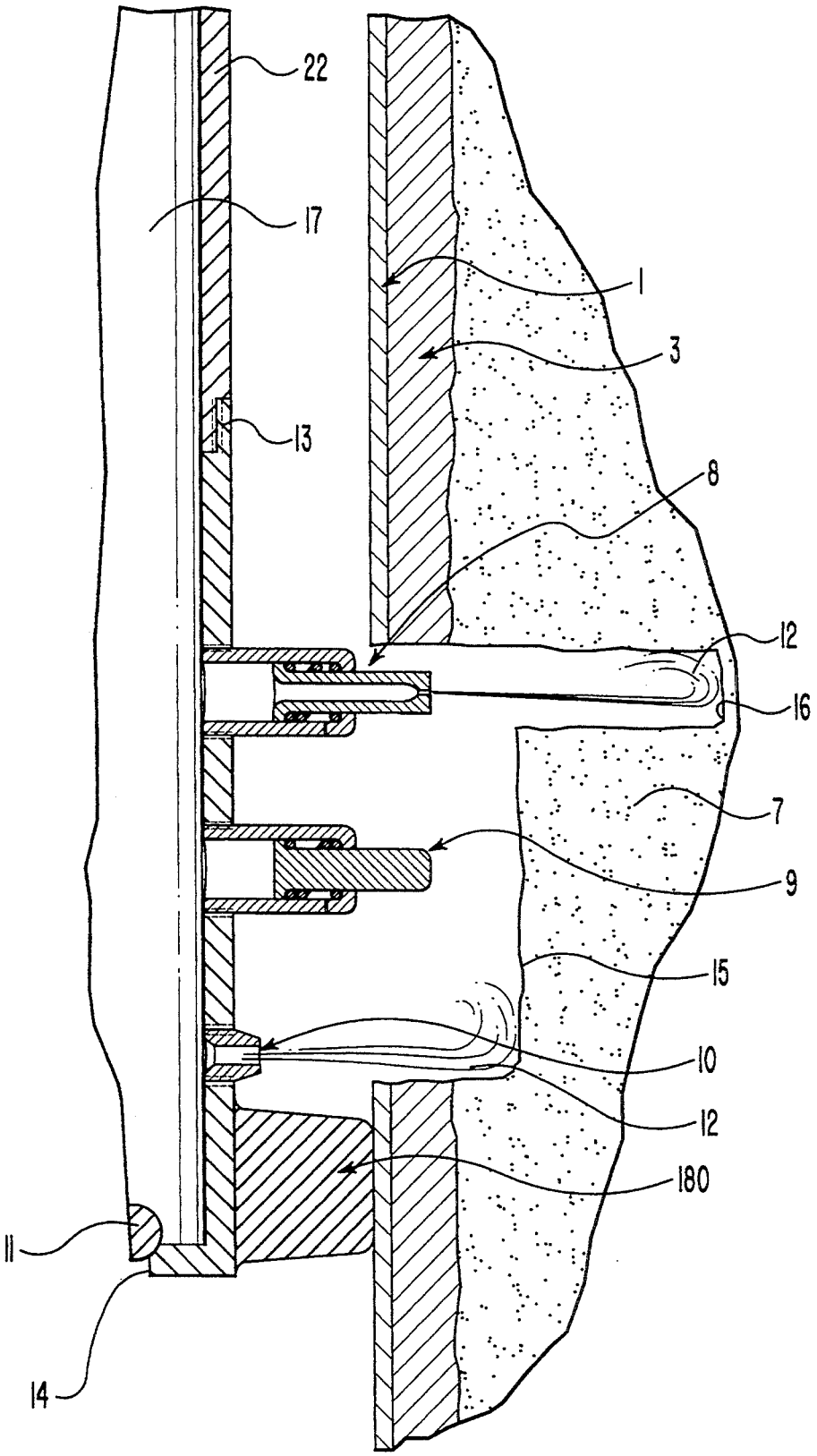
FIG. 4 is a cutaway view of one side of the perforator of FIG. 1, and illustrates a stabilizer extending from the perforator to stabilize the perforator in the center of the well about the axis thereof as the perforator ejects an abrasive liquid from the telescopic nozzle and from the jets of the double jet nozzle while the telescopic guide fin and the telescopic nozzle are in the respective extended positions thereof.

FIG. 4 illustrates cutting slots into casing 1, cement bond 3 and rock formation 7 by jetting action using perforator 4. As described above, a surface lifting device (not shown) lowers drill pipe string 2 into the wellbore with perforator 4 at the bottom end thereof.

Preferable, the inventive perforator will have a centralizing means for centering the perforator about the axis of the wellbore during the cutting of slots. By way of example and illustration of the centralizing means. FIG. 4 shows one side of perforator 4 with a centralizer 180 extending therefrom so as to keep perforator 4 in the center of the wellbore about axis 17. Another centralizer (not shown), of similar dimensions, is preferably located on the other side of drill pipes string 2 opposite centralizer 180 in order to accomplish the purpose of centralizing perforator 4 in the wellbore.

In use, the pressure is increased in perforator 4 by the pumps (not shown) pumping the abrasive liquid into perforator 4 through path 5. To permit such an increase in pressure, ball 11 is seated against ball check valve seat 14 to hole the abrasive liquid in perforator 4. The increase in pressure in perforator 4 causes inner cylinder 50 in outer cylinder 20 of telescopic nozzle 8 to move into the extended position thereof shown in FIG. 4, and causes guide fin piston 70 in outer cylinder 20 of telescopic guide fin 9 to move into the extended position thereof shown in FIG. 4.

In order to gradually move inner cylinder 50 and guide fin piston 70 into respective extended positions thereof, the respective outer cylinders 20 thereof are prefilled (as described above) with a liquid, such as water, so that the liquid slowly exits the respective small holes 80 as the pressure in perforator 4 increases and the respective extended positions thereof are reached. Thus, the hydraulic pressure from the prefilling of the respective outer cylinders 20 with the liquid prevents inner cylinder 50 and guide fin piston 70 from rapid movement to the respective extended positions thereof.

As the pumps (not shown) are turned on and drill pipe 2 is slowly lowered further down in the wellbore from an initial slot cutting position at a certain optimal rate of movement, telescopic nozzle 8 and double jet nozzle 10 begin to cut slots in wellbore. Double jet nozzle 10 cuts to a slot depth 15 through casing 1, cement bond 3, and into rock formation 7. The slot cut to depth 15 by double jet nozzle 10 is wide enough for guide fin piston 70 and inner cylinder 50 of telescopic nozzle 8 to telescopically enter into the slot.

As the abrasive liquid is pumped into perforator 4, guide fin piston 70 prevents perforator 4 from rotating about axis 17, which in turn controls the direction of the slot being cut by perforator 4. The rate of downward motion of perforator 4 is controlled by the surface lifting device (not shown), which rate is preferably optimal so as to provide maximum penetration of the slot being cut into rock formation 7.

When telescopic nozzle 8 has moved to the initial position where double jet nozzle 10 began cutting a slot, inner cylinder 50 of telescopic nozzle 10 will move to the extended position thereof, shown in FIG. 4, and will telescope inner cylinder 50 into the slot cut by double jet nozzle 10, which causes the slot to be deepened to a slot depth 16 as abrasive liquid is ejected from telescopic nozzle 8. The telescopic design of inner cylinder 50 allows telescopic nozzle 8 to make a deep cut to slot depth 16, deeper than slot depth 15 which is cut by double jet nozzle 10. As can be seen, utilization of the combination of double jet nozzle 10 to cut initial slot depth 15 and telescopic nozzle 8 to cut to the second slot depth allows the dual benefits of deeper penetration and faster cutting in rock formation 7.

The rate that perforator 4 moves along wellbore axis 17 is preferably not higher than a rate that provides for a maximum penetration depth for a given velocity of abrasive liquid ejected from jet 60 of telescopic nozzle 8 and jets 120*a*, 120*b* of double jet nozzle 10 at a given pressure in perforator 4.

After the cutting slot depths 15, 16, the motion of drill pipe string 2 is stopped and the pump (not shown) is also stopped. The pump is then reversed to reverse the flow direction of the abrasive liquid in path 5 of drill pipes string 2. The prefilled liquid in respective outer cylinders 20 of telescopic nozzle 8 and telescopic guide fin 9 will have exited from respective small holes 80. The reversed pressure created by the pump causes respective springs 40 of telescopic nozzled 8 and telescopic guide fin 9 to move inner cylinder 50 of telescopic nozzle 8 and guide fin piston 70 into the respective retracted positions thereof. The negative pressure of the abrasive liquid in perforator 4 causes ball 11 to be displaced from ball check valve seat 14 and the abrasive liquid in perforator 4 to exit perforator 4. The well may then be washed by pumping into the well a liquid that does not have an abrasive material therein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A perforator for cutting into the wall of a wellbore comprising:

a perforator body;

a port for receiving into the perforator body a liquid under pressure;

a jet nozzle means for ejecting therefrom the liquid under pressure in the perforator, said jet nozzle means moving into an extended position thereof away from the perforator body as a function of the pressure of the liquid in the perforator;

a biasing means for urging the jet nozzle means into a retracted position thereof towards the perforator body;

a stationary nozzle means for cutting a slot into the wall of the wellbore, the stationary nozzle means being stationary relative to the perforator body and having a plurality of jets for ejecting therefrom the liquid under pressure in the perforator body; and said jet nozzle means further comprising:

an inner cylinder situated in an outer cylinder, the inner cylinder moving between a retracted position into the outer cylinder and an extended position out of the outer cylinder and away from the perforator body and into the slot cut into the wall of the wellbore by the stationary nozzle means, said inner cylinder moving into the extended position thereof as a function of the pressure of the liquid in the perforator body, the inner cylinder having a jet for ejecting therefrom the liquid under pressure so as to cut a slot into the wall of the wellbore that is deeper than the slot cut by the stationary nozzle means; and a means for biasing the inner cylinder into the retracted position thereof.

2. The perforator as defined in claim 1, further comprising:

a stabilizer means, extending from the perforator body, for centering the perforator body about the longitudinal axis of the wellbore.

3. The perforator as defined in claim 1, further comprising a telescopic guide fin means for preventing the perforator from rotating about a longitudinal axis of the wellbore, said telescopic guide means comprising:

a guide fin situated in an outer cylinder, the guide fin moving between a retracted position into the outer cylinder and an extended position out of the outer cylinder and away from the perforator body, said guide fin moving into the extended position thereof as a function of the pressure of the liquid in the perforator body; and a means for biasing the guide fin into the retracted position thereof.

4. The perforator as defined in claim 3, wherein said outer cylinder of said jet nozzle means has an exit hole therein for providing fluid communication therethrough to the wellbore when the inner cylinder of the jet nozzle means is in the retracted position thereof; and wherein said outer cylinder of said telescopic guide fin means has an exit hole therein for providing fluid communication therethrough to the wellbore when the guide fin is in the retracted position thereof.

5. The perforator as defined in claim 1, further comprising a check valve means for holding and releasing the pressure of the liquid in the perforator body.

6. An apparatus for cutting into the wall of a wellbore by ejecting therefrom an abrasive liquid and comprising:

a perforator body having therein said abrasive liquid under a pressure;

a plurality of jet nozzle means for ejecting therefrom said abrasive liquid out of said perforator body so as to cut slots into the wall of said wellbore;

a telescopic guide fin means for preventing the perforator body from rotating within the wellbore and for extending into the slots cut into the wall of the wellbore by the plurality of jet nozzle means;

a plurality of telescopic nozzle means for ejecting therefrom said abrasive liquid out of said perforator body and for extending into the slots cut into the wall of the wellbore by the plurality of jet nozzle means so as to cut slots into the wall of said wellbore deeper than said slots cut by said plurality of jet nozzle means;

wherein each said telescopic nozzle means comprises:

an outer cylinder extending from the perforator body perpendicularly to a longitudinal axis of the wellbore;

an inner cylinder extending from the perforator body perpendicularly to the longitudinal axis of the wellbore and slidably moveable within the outer cylinder between an extended position thereof and a retracted position thereof, said inner cylinder ejecting therefrom said abrasive liquid out of said perforator body and extending into the slots cut into the wall of the wellbore by said plurality of jet nozzle means so as to cut a slot into the wall of said wellbore deeper than said slots cut by said plurality of jet nozzle means; and a means for biasing the inner cylinder into the retracted position thereof, said inner cylinder being moved into the extended position thereof under said pressure of said liquid in said perforator body.

7. The apparatus as defined in claim 6 further comprising a stabilizer means, extending from the perforator body, for centering the perforator body about a longitudinal axis of the wellbore.

8. The apparatus as defined in claim 6, wherein said perforator body is symmetrical about a longitudinal axis of the wellbore and has a top and a bottom, said top of said perforator body having a port therein for receiving therethrough said abrasive liquid under said pressure.

9. The apparatus as defined in claim 6, wherein each said jet nozzle means has a plurality of jet nozzles each of which projects essentially perpendicularly from said perforator body and ejects therefrom a stream of said abrasive liquid.

10. The apparatus as defined in claim 6, wherein each said telescopic guide fin means comprises:

an outer cylinder extending from the perforator body perpendicularly to a longitudinal axis of the wellbore;

a guide fin slidably moveable within the outer cylinder between an extended position thereof and a retracted position thereof; and a means for biasing the guide fin into the retracted position thereof, said guide fin being moved into the extended position thereof under said pressure of said liquid in said perforator body.

11. The apparatus as defined in claim 10, wherein each said outer cylinder of each said telescopic nozzle means has an exit hole therein for providing fluid communication from an essentially annular area between said each said outer cylinder of the telescopic nozzle means and the inner cylinder of each said telescopic nozzle means in the retracted position thereof to an essentially annular area between the well-bore and the perforator body; and wherein each of said outer cylinder of each said telescopic guide fin means has an exit hole therein for providing fluid communication from an essentially annular area between said each said outer cylinder of the telescopic guide fin means and the guide fin of each said telescopic guide fin means in the retracted position thereof to an essentially annular area between the well-bore and the perforator body.

12. The apparatus as defined in claim 6, further comprising means for controlling release of said abrasive fluid in the perforator body therefrom as a function of said pressure of said abrasive fluid in said perforator body.

13. The apparatus as defined in claim 12, wherein said means for controlling release of said abrasive fluid in the perforator body comprises:

a valve seat situated at the bottom of the perforator body and providing a fluid communication between the perforator body and the wellbore; and a valve for preventing exit of said abrasive liquid under said pressure in said perforator body through said valve seat to said wellbore by making a sealing and conforming fit with the valve seat when said abrasive liquid is under said pressure in said perforator body, and for releasing said abrasive liquid through said valve seat to said wellbore during an absence of said pressure of said abrasive liquid in said perforator body.

14. An apparatus for cutting into the wall of a wellbore by ejecting therefrom an abrasive liquid, said wellbore having a longitudinal axis, and comprising:

a drill pipe string;

a perforator body, symmetrical about the longitudinal axis of the wellbore, having a top and a bottom, said top of said perforator body being attached to the drill pipe string and having a port therein that is in fluid communication with the drill pipe string for receiving therethrough said abrasive liquid under a pressure;

a plurality of jet nozzle means for ejecting therefrom said abrasive liquid out of said perforator body, each said jet nozzle means having a plurality of jet nozzles, each jet nozzle of said plurality of jet nozzles projecting essentially perpendicularly from said perforator body and ejecting therefrom a stream of said abrasive liquid so as to cut a slot in said wellbore;

a plurality of telescopic guide fin means for preventing the perforator body from rotating about the longitudinal axis of the wellbore, each said telescopic guide fin means comprising:

an outer cylinder extending from the perforator body perpendicularly to the longitudinal axis of the wellbore;

a guide fin slidably moveable within the outer cylinder between an extended position thereof and a retracted position thereof, said extended position of said guide fin extending into the slots cut into the wall of the wellbore by said plurality of jet nozzle means;

a means for biasing the guide fin into the retracted position thereof, said guide fin being moved into the extended position thereof under said pressure of said liquid in said perforator body;

said outer cylinder having an exit hole therein for providing fluid communication from an essentially annular area between the outer cylinder and the guide fin in the retracted position thereof to an essentially annular area between the wellbore and the perforator body;

a plurality of telescopic nozzle means for ejecting therefrom said abrasive liquid out of said perforator body, each said telescopic nozzle means comprising:

an outer cylinder extending from the perforator body perpendicularly to the longitudinal axis of the wellbore;

an inner cylinder extending from the perforator body perpendicularly to the longitudinal axis of the wellbore and slidably moveable within the outer cylinder between an extended position thereof and a retracted position thereof, said extended position of said inner cylinder extending into the slots cut into the wall of the wellbore by said plurality of jet nozzle means;

a means for biasing the inner cylinder into the retracted position thereof, said inner cylinder being moved into the extended position thereof under said pressure of said liquid in said perforator body; and said outer cylinder having an exit hole therein for providing fluid communication from an essentially annular area between the outer cylinder and the inner cylinder in the retracted position thereof to an essentially annular area between the wellbore and the perforator body.

15. The apparatus as defined in claim 14 further comprising means for controlling release of said abrasive fluid in the perforator body therefrom as a function of said pressure of said abrasive fluid in said perforator body.

16. The apparatus as defined in claim 15, wherein said means for controlling release of said abrasive fluid in the perforator body comprises:

a valve seat situated at the bottom of the perforator body and providing a fluid communication between the perforator body and the wellbore; and a valve for preventing exit of said abrasive liquid under said pressure in said perforator body through said valve seat to said wellbore by making a sealing and conforming fit with the valve seat when said abrasive liquid is under said pressure in said perforator body, and for releasing said abrasive liquid through said valve seat to said wellbore during an absence of said pressure of said abrasive liquid in said perforator body.

17. The apparatus as defined in claim 14 further comprising a stabilizer means, extending from the perforator body, for centering the perforator body about the longitudinal axis of the wellbore.

* * * * *